US005304420A

United States Patent [19]

Hirakawa et al.

[11] Patent Number: 5,304,420

[45] Date of Patent: Apr. 19, 1994

[54] VINYL ALCOHOL UNIT-CONTAINING POLYMER FIBERS HAVING HIGH MOISTURE ABSORPTION AND HIGH WATER ABSORPTION

[75] Inventors: Kiyoshi Hirakawa; Kazuhiko Tanaka; Masao Kawamoto; Tomoyasu Tsuda, all of Kurashiki, Japan

[73] Assignees: Kuraray Co., Ltd., Okayama; Yunitika Ltd., Hyogo, both of Japan

[21] Appl. No.: 932,878

[22] Filed: Aug. 20, 1992

[30] Foreign Application Priority Data

Aug. 22, 1991 [JP] Japan ..... 3-233759

[51] Int. Cl.[5] ..... D02G 3/00; C08K 5/04; C08L 29/04

[52] U.S. Cl. ..... 428/373; 428/229; 524/503; 525/57; 525/58

[58] Field of Search ..... 524/503; 525/57, 58; 428/229, 373

[56] References Cited

U.S. PATENT DOCUMENTS

| | | | |
|---|---|---|---|
| 5,023,296 | 6/1991 | Moriyama et al. | 525/58 |
| 5,024,897 | 6/1991 | Mason et al. | 525/58 X |
| 5,032,434 | 7/1991 | Sanchez et al. | 525/58 X |
| 5,159,013 | 10/1992 | Takida et al. | 525/58 X |
| 5,189,097 | 2/1993 | LaFleur et al. | 525/58 |

FOREIGN PATENT DOCUMENTS 0251676 1/1988 European Pat. Off. .

OTHER PUBLICATIONS

Zh Kakuyo-Kai, Derwent Abstracts, AN=87-017942, 1986.

*Primary Examiner*—Judy M. Reddick

*Attorney, Agent, or Firm*—Wenderoth, Lind & Ponack

[57] ABSTRACT

Fibers composed of a vinyl alcohol unit-containing polymer, or composite fibers, yarns or fiber products composed of the phase of the vinyl alcohol unit-containing polymer and the other fiber-forming polymer phase are acetalized with at least one of aldehyde compounds represented by the formulas, $$OHC—CH_2—C(R^1)(R^2)—COOB$$

and $$OCH—C(R^3)(R^4)—COOB$$

wherein B is a hydrogen atom or an alkyl group, $R^1$, $R^2$, $R^3$ and $R^4$, independently from each other, denote a hydrogen atom or an alkyl group, and at least one of $R^1$ and $R^2$ and at least one of $R^3$ and $R^4$ are alkyl groups, and a carboxyl group is then converted into a salt to form fibers, yarns or fiber products having high moisture absorption and high water absorption.

According to this invention, there are provided fibers, yarns and fiber products which have durability, high moisture absorption and high water absorption that are not lost even by dyeing treatment or cleaning, and which are soft and well bulky and have good feeling like natural fibers; besides they can be produced without causing troubles in the fiberization step or allowing coloration.

7 Claims, No Drawings

VINYL ALCOHOL UNIT-CONTAINING POLYMER FIBERS HAVING HIGH MOISTURE ABSORPTION AND HIGH WATER ABSORPTION

DETAILED DESCRIPTION OF THE INVENTION

1. Field of Industrial Utilization

This invention relates to fibers composed of a vinyl alcohol unit-containing polymer having high moisture absorption and high water absorption, especially fibers composed of an ethylene-vinyl alcohol copolymer, products of said fibers, and a process for producing same. More specifically, this invention relates to fibers composed of the polymer having high moisture absorption and high water absorption, said fibers showing high swelling when wetted with water, a product made of said fibers, and a process for producing same.

2. Prior Art

Synthetic fibers of polyesters, polyamides, etc. have been widely used not only for clothing but also industrially because of their excellent physical and chemical characteristics, and have possessed an industrially important value. These fibers are, however, low in moisture absorption and water absorption and have therefore been limited in usage requiring moisture absorption and water absorption, such as underwear, intermediate garments, bed sheets, towels, etc.

As a method to impart moisture absorption and water absorption to synthetic fibers, there have been proposed, for example, a method in which polyester fibers are post-treated with a hydrophilic treating agent, and a method in which moisture absorption and water absorption are imparted by making porous the surfaces or the insides of the polyester fibers. These methods have nevertheless suffered defects that moisture absorption and water absorption are not improved enough and besides the imparted moisture absorption and water absorption are gradually decreased by cleaning. In order to remedy such defects, a method has been recently proposed in which the polyester fibers are graft-polymerized with a monomer such as acrylic acid or methacrylic acid. Nevertheless, it has not yet reached a sufficient practical level. The principal reason is that since the polyesters have a rigid structure, contain no reactive functional group and are hydrophobic, graft polymerization of the monomer is hardly conducted, and when the graft polymerization is forcibly conducted, feeling and strength of fibers are decreased.

A method of graft-polymerizing the polyester fibers with the monomer such as acrylic acid or methacrylic acid is described in the following literature.

(1) Journal of Fiber Academy, vol. 28, No. 9, pp. 343–352 (1972)

(2) Journal of Fiber Academy, vol. 35, No. 1, pp. 70–78 (1978)

Meanwhile, the following literature describes improvement by acetalization of polyvinyl alcohol or its fibers.

(3) Japanese Patent Publication No. 2914/1957

It describes an improved method in which polyvinyl alcohol fibers are acetalized with an aldehyde having a carboxylic acid group to crimp the fibers, and shows chlorophthalic aldehyde, phthalic acid aldehyde or adipic acid aldehyde as the aldehyde.

(4) Japanese Patent Publication No. 4012/1961

It involves a process for producing polyvinyl alcohol fibers having improved dyeability, describing that the polyvinyl alcohol is acetalized with an aldehyde having an acid group, such as glyoxylic acid, carboxyacetaldehyde or sulfobenzaldehyde.

(5) Japanese Laid-open Patent Application No. 275467/1986

It describes a process for producing acetalized polyvinyl alcohol fibers dyeable with a cationic dye, indicating that formalin is solely used as an acetalizing agent.

SUMMARY OF THE INVENTION

The problem of this invention is to provide synthetic fibers having excellent durability high moisture absorption and high water absorption, being soft and well bulky, having good feeling like natural fibers and showing less decrease in strength, etc., as well as a simple means of obtaining such synthetic fibers without troubles in designing of the polymer or fiberization step and without occurrence of undesirous coloration, etc.

The present inventors have conducted studies to solve the above problems, and consequently have found that the above problems can be solved by fibers composed of a vinyl alcohol unit-containing polymer acetalized with a specific aldehyde compound containing a carboxyl group, especially fibers composed of an ethylene-vinyl alcohol copolymer.

That is, according to this invention, there are provided fibers composed substantially of a vinyl alcohol unit-containing polymer whose alcoholic hydroxyl group is modified with at least one of groups represented by the formulas $$>CH—CH_2—C(R^1)(R^2)—COOA \quad (I)$$

and $$>CH—C(R^3)(R^4)—COOA \quad (II)$$

wherein A denotes a hydrogen atom or a cation capable of forming a salt with a carboxyl group, $R^1$, $R^2$, $R^3$ and $R^4$, independently from each other, denote a hydrogen atom or an alkyl group, and at least one of $R^1$ and $R^2$ and at least one of $R^3$ and $R^4$ are alkyl groups, via an oxygen atom of the alcoholic hydroxyl group.

Further, according to this invention, there are provided composite fibers composed substantially of (a) a phase of a vinyl alcohol unit-containing polymer modified with at least one of the groups of formulas (I) and (II) and (b) the other fiber-forming polymer phase.

Still further, according to this invention, there is provided a process for producing the fibers, the composite fibers or the products of these fibers in this invention, which comprises contacting (1) fibers composed of an unmodified vinyl alcohol unit-containing polymer, (2) composite fibers composed substantially of a phase of an unmodified vinyl alcohol unit-containing polymer and the other fiber-forming polymer phase, or (3) products of these fibers and/or composite fibers with at least one of aldehyde compounds represented by the formulas $$OHC—CH_2—C(R^1)(R^2)—COOB \quad (Ia)$$

and $$OHC—C(R^3)(R^4)—COOB \quad (IIa)$$

wherein $R^1$, $R^2$, $R^3$ and $R^4$ are as defined in formulas (I) and (II), and B denotes a hydrogen atom or an alkyl group, to acetalize the hydroxyl group based on the vinyl alcohol unit of the polymer; and when B in formula (Ia) or (IIa) is the hydrogen atom, leaving the carboxyl group intact or treating it with an alkali compound to convert it into a salt (as —COOA); or when B is the alkyl group, converting the ester group into —COOA by hydrolysis.

DESCRIPTION OF THE PREFERRED EMBODIMENTS OF THE INVENTION

The fibers and the composite fibers of this invention will be described in more detail below.

It is advisable that the vinyl alcohol unit-containing polymer which is a basic component in the fibers of this invention is a polymer composed of recurring units based on vinyl alcohol alone or a copolymer composed of recurring units based on vinyl alcohol and the other vinyl monomer or olefinic monomer. It is especially preferable that the amount of the vinyl alcohol units of all the recurring units is about 30 to 99 mol % which enables melt-spinning.

It is advisable that the polymer in this invention is an olefin-vinyl alcohol copolymer because the fibers can be obtained by melt-spinning with an ordinary melt-spinning machine. Desirous examples of the olefin being copolymerized are $C_2$–$C_4$ alpha-olefins such as ethylene, propylene, butylene and isobutylene. Especially preferable is ethylene due to its heat resistance, hot water resistance and fiber form retention.

A typical example of the vinyl alcohol unit-containing polymer in this invention is an ethylene-vinyl alcohol copolymer. The ethylene-vinyl alcohol copolymer and the fibers composed of it will be explained below, which is merely for understanding of this invention; this invention is not limited to said copolymer and fibers. Of course, the aforesaid other (co)polymer and the fibers composed of it are also included in this invention.

The aforesaid ethylene-vinyl alcohol copolymer (hereinafter abbreviated as an "Et/VA copolymer") is a copolymer composed mainly of ethylene units and vinyl alcohol units. In order to obtain fibers having high moisture absorption and high water absorption in this invention, it is advisable that the proportion of the vinyl alcohol units in the Et/VA copolymer is about 30 to 70 mol %, especially about 40 to 70 mol % based on the total amount of the recurring units. Meanwhile, it is advisable that the units other than the vinyl alcohol units are ethylene units or the ethylene units and the other vinyl monomer units.

It is advisable that the Et/VA copolymer is composed substantially of the ethylene units and the vinyl alcohol units and on this occasion the proportion of the ethylene units is about 30 to 70 mol %. When the proportion of the ethylene units in the Et/VA copolymer is less than 30 mol %, i.e., the proportion of the vinyl alcohol units is more than 70 mol %, spinnability in fiberization by the melt spinning method becomes poor, with the result that monofilaments or yarns are often broken in spinning or drawing and a less flexible product is provided. Moreover, when a high-melting polymer such as polyethylene terephthalate is used as the other fiber-forming polymer in producing composite fibers composed of the Et/VA copolymer phase and the other fiber-forming polymer phase, a high spinning temperature of more than 250° C. is needed. In that case, when the proportion of the ethylene units is less than 30 mol %, heat resistance of the Et/VA copolymer becomes insufficient, and good composite fibers cannot be obtained.

On the other hand, when the proportion of the ethylene units exceeds 70 mol %, the proportion of the vinyl alcohol units, i.e., the hydroxyl groups necessarily becomes less, and a rate of modification with the group of formula (I) and/or the group of formula (II) [hereinafter referred to as a "group (I)" and a "group (II)"] is decreased, making it impossible to obtain the intended fibers having high moisture absorption, high water absorption and feeling like natural fibers.

The Et/VA copolymer which is a basic structure may be a non-crosslinked chain copolymer or a copolymer crosslinked by a suitable method as will be later described.

The Et/VA copolymer can be formed by various methods. It can usually be formed by saponifying a vinyl acetate portion of the ethylene/vinyl acetate copolymer. On that occasion, a degree of saponification may be about 95% or more. When the degree of saponification becomes low, crystallinity of the copolymer is decreased and properties such as strength, etc. are also lowered. Besides, the copolymer tends to be softened, a trouble occurs in the step of fiberization by the melt spinning and feeling of the obtained fibers becomes poor. Thus, it is unwanted.

The Et/VA copolymer may be usually one having a number average molecular weight of about 5,000 to 25,000. The Et/VA copolymer is marketed under a trademark "EVAL®" by Kuraray Co., Ltd. and under a trademark "SOARNOL®" by Japan Synthetic Chemical Industry Co., Ltd., and can thus easily be obtained. It is also possible to use a product formed by saponifying a commercial copolymer of ethylene and vinyl acetate, or forming an Et/vinyl acetate copolymer from ethylene and vinyl acetate by radical polymerization, etc. and saponifying it.

When, in either case, alkali metal ions such as a sodium ion and a potassium ion or alkaline earth metal ions such as a calcium ion and a magnesium ion are present in the Et/VA copolymer, breaking of a main chain, elimination of a side chain, excessive crosslinking, etc. occur in the copolymer, which leads to decrease in heat stability of the copolymer, breaking of yarns in spinning by gelation of the copolymer, clogging of a spinning filter, consequential rapid decrease in pressure of a spinning pack, shortening of a nozzle life, etc. Accordingly, it is advisable that the contents of these ions are as low as possible, usually about 100 ppm or less, especially 50 ppm or less.

In the fibers, the yarns, and the fiber products of this invention, the alcoholic hydroxyl group of the Et/VA copolymer has to be modified with at least one of the groups (I) and (II). The Et/VA copolymer may be modified with the group (I) or (II) alone or both the groups (I) and (II).

It is advisable that the rate of modification of the Et/VA copolymer with the group (I) and/or the group (II) is about 1 to 45 mol %, especially 5 to 30 mol % by the total amount of the groups (I) and (II) based on the total number of mols of the vinyl alcohol units in the copolymer. The total number of mols of the vinyl alcohol units here referred to is a total number of mols of units when the saponified vinyl alcohol unit, the non-saponified vinyl acetate unit and the hydroxyl group of the vinyl alcohol are converted into ether groups, etc. by acetalization, etc.

When the rate of modification of the vinyl alcohol units with the group (I) and/or the group (II) is less than 1 mol %, it is impossible to obtain fibers good in moisture absorption and water absorption. If the fibers are formed into underwear, for example, there is insufficient moisture absorbability for sweating; thus, fibers having good feeling can hardly be obtained. While, when the rate of modification exceeds 45 mol %, the Et/VA copolymer is swollen too much in water and dissolution in water occurs at times, so that strength of the fibers notably decreases and coloration is liable to occur.

The rate of modification of the Et/VA copolymer with the group (I) and/or the group (II) is about 0.5 to 31 mol %, especially preferably about 2.0 to 20 mol % by the total amount of the groups (I) and (II), based on the total amount of the recurring units.

Modification of the alcoholic hydroxyl group with the group (I) and/or the group (II) is carried out by producing fibers or composite fibers from the Et/VA copolymer by melt spinning, if required, further forming yarns or fiber products such as a fabric, etc. from the above fibers, or acetalizing commercial Et/VA copolymer fibers, yarns or fiber products with at least one of the aldehyde compounds of formula (Ia) and (IIa) [hereinafter referred to as a "compound (Ia)" and a "compound (IIa)"]; and when B is the hydrogen atom, leaving the carboxyl group intact or treating it with an alkali compound to convert it into a salt; or when B is the alkyl group, hydrolyzing the ester linkage into a carboxylic acid or its salt.

The above acetalization of the fibers or the fiber products of the Et/VA copolymer may be performed in an aqueous medium using a strong inorganic acid such as sulfuric acid or hydrochloric acid as an acetalization catalyst. Sulfuric acid is especially preferable from the aspect of reaction efficiency.

The concentration of the strong acid is about 1 to 5N. Especially preferrable is 2 to 4N. When the concentration of the strong acid is lower than 1N, acetalization is not carried out enough, and fibers poor in moisture absorption and water absorption are obtained. When it is higher than 5N, the fibers undesirously become brittle.

The temperature of the acetalization reaction is preferably about 40° to 110° C. When it is lower than 40° C., the acetalization reaction rate becomes quite low, making it impossible to conduit acetalization with good efficiency. When it is higher than 110° C. the fibers, the yarns and the fiber products are discolored or rendered brittle; thus, it is unwanted.

The concentration of the compound (Ia) and/or the compound (IIa) in the acetalization treating solution is that the total amount of both the compounds is about 0.005 to 0.5 mol, preferably 0;02 to 0.2 mol per liter of the treating solution. When the total amount of the aldehyde compounds (Ia) and (IIa) is less than 0.005 mol/liter, the proportions of the group (I) and/or the group (II) introduced into the the ethylene-vinyl alcohol copolymer are small, and good moisture absorption and good water absorption are not obtained.

By the above acetalization treatment and the subsequent treatment, both the two bonding sites (i.e., >C on the left side) in the group (I) and/or the group (II) are bound via —O— (acetal linkage) to hydroxyl groups based on vinyl alcohols of the Et/VA copolymer.

The modified copolymer is thus formed wherein the group (I) and/or the group (II) is bound to the main chain of the Et/VA copolymer in a pendant state.

As described above, in the groups (I) and (II) and the compounds (Ia) and (IIa), A is a hydrogen atom or a cation capable of forming a salt with a carboxyl group, $R^1$, $R^2$, $R^3$ and $R^4$ are, independently from each other, a hydrogen atom or an alkyl group, at least one of $R^1$ and $R^2$ and at least one of $R^3$ and $R^4$ are alkyl groups, and B is a hydrogen atom or an alkyl group. A is preferably the cation. Examples of the cation are various metal ions, an ammonium ion and a quaternary ammonium ion. When A is a divalent or higher cation, it is ionically bonded to carboxyl groups in number equal to the valence to form a salt. Preferable examples of A are ions of alkali metals such as sodium and potassium, ions of alkaline earth metals such as calcium and magnesium, and an ammonium ion. Of these, the alkali metal ions such as sodium and potassium are most preferable because moisture absorption and water absorption can be maximally exhibited.

The carboxyl group or the ester group —COOB in the fibers, the yarns and the fiber products of the Et/VA copolymer acetalized with the compound (Ia) and/or the compound (IIa) can be converted into a salt by reacting the fibers, the yarns and the fiber products such as the fabric acetalized with the compound (Ia) and/or the compound (IIa) with hydroxides of alkali metals or alkaline earth metals, carbonates (especially, potassium hydroxide, sodium hydroxide, potassium carbonate, sodium carbonate, calcium hydroxide and magnesium hydroxide), ammonium hydroxide or amines. Salt formation can be carried out at any stage before the product is provided; it is especially preferable to conduct salt formation after dyeing. Salt formation is conducted by a method in which the acetalized fibers or fiber products are dipped in an aqueous solution of the salt forming agent such as the aforesaid alkali metal hydroxide, or a method in which the aqueous solution of the salt forming agent is applied to the fibers, the yarns, and the fiber products by padding, spray or shower.

When the groups $R^1$, $R^2$, $R^3$, $R^4$ and B in the groups (I) and (II) and the compounds (Ia) and (IIa) are alkyl groups, lower alkyl groups having 1 to 4 carbon atoms are preferable. A methyl group is especially preferable.

Desirous examples of the compounds (Ia) and (IIa) are as follows.

$OHC—CH_2—C(H)(CH_3)—COOB$ $OHC—CH_2—C(CH_3)_2—COOB$ $OHC—CH_2—C(H)(C_2H_5)—COOB$ $OHC—CH_2—C(CH_3)(C_2H_5)—COOB$ $OHC—C(H)(CH_3)—COOB$ $OHC—C(CH_3)(CH_3)—COOB$ $OHC—C(H)(C_2H_5)—COOB$ $OHC—C(CH_3)(C_2H_5)—COOB$

Of the above compounds, $OHC—CH_2—C(H)(CH_3)—COOB$ and $OHC—C(CH_3)(CH_3)—COOB$ are preferable because heat stability is good, the acetalization reaction can therefore be carried out at a high temperature and a high reaction rate, reactivity with the alcoholic hydroxyl group of the Et/VA copolymer is great and moisture absorption and water absorption of the resulting acetalized product are high.

Aldehyde compounds (not included in this invention) wherein $R^1$, $R^2$, $R^3$ and $R^4$ are all hydrogen atoms in formulas (Ia) and (IIa), i.e., $$OHC—CH_2—CH_2—COOB,$$

and $$OHC—CH_2—COOB$$

are less reactive with the alcoholic hydroxyl group of the Et/VA copolymer. Even if these compounds are reacted with said alcoholic hydroxyl group, heat stability is low under heating at high temperatures, and good moisture absorption and good water absorption cannot be imparted to the Et/VA copolymer fibers.

The modified Et/VA copolymer acetalized with the compound (Ia) and/or the compound (IIa) has usually a melting point of about 150° to 180° C., and decrease in melting point occurs in hot water, so that the copolymer is liable to soften even below 150° C. The softening phenomenon occurs in some process or conditions, which results at times in agglutination of monofilaments and providing hard feeling. Therefore, the Et/VA copolymer may be crosslinked as described below.

In order to improve a softening point, heat resistance or hot water resistance of the Et/VA copolymer and the modified Et/VA copolymer acetalized with the compound (Ia) and/or the compound (IIa), the Et/VA copolymer may be crosslinked separately from the above modification treatment. At that time, the crosslinking can be carried out by a known method of crosslinking the vinyl alcohol unit-containing copolymer. Examples thereof are crosslinking with an organic crosslinking agent such as a divinyl compound, an aldehyde compound, e.g., a monoaldehyde typified by formaldehyde or a dialdehyde, or a polyisocyanate, e.g., a diisocyanate; crosslinking with an inorganic crosslinking agent such as a boron compound, and crosslinking with radiation such as gamma rays or electron rays, or light.

When the crosslink acetalization treatment is conducted with the dialdehyde, for example, it is advisable to use a strong acid such as sulfuric acid, hydrochloric acid or formic acid. On that occasion, it is advisable that the concentration of the strong acid is about 0.05 to 5N, the concentration of the dialdehyde solution is about 0.2 to 500 g/liter, and the reaction temperature is about 15° C. to about 135° C. Glutaraldehyde, 1,9-nonanedial, and 2-methyl-1,8-octanedial are practically desirable as the dialdehyde owing to the high reaction rate. It is advisable that degree of crosslink acetalization with the dialdehyde is about 2 to 5 mol % relative to the alcoholic hydroxyl group unit from the aspect of resistance to high-temperature dyeing of more than 110° C. and iron resistance. When it is higher than 5 mol %, the degree of acetalization with the compound (Ia) and/or the compound (IIa) is undesirously decreased.

When an unreacted aldehyde remains after the crosslink acetalization treatment, the dyed product sometimes fades. It is therefore advisable that the unreacted aldehyde is oxidized with an oxidizing agent to convert it into a carboxylic acid or its salt.

The crosslinking treatment may be carried out before modifying the fibers, the composite fibers, the yarns or the fiber products with the compound (Ia) and/or the compound (IIa), simultaneously with said modifying treatment or after said modifying treatment. It is especially preferable from the aspect of processability, etc. that the crosslinking treatment is carried out after the modifying treatment.

Accordingly, the fibers, the composite fibers, the yarns and the fiber products made of the Et/VA copolymer modified with at least one of the groups (I) and (II) in this invention include both those which do not undergo the crosslinking treatment and those which undergo the crosslinking treatment.

Moreover, as stated above, this invention includes the composite fibers composed of the modified Et/VA copolymer phase and the other fiber-forming polymer phase, besides the fibers made only of the Et/VA copolymer modified with the group (I) and/or the group (II).

In case of the composite fibers, it is advisable that a volume ratio of the modified Et/VA copolymer phase and the other fiber-forming polymer phase is about 10:90 to 90:10. When it is deviated from the above range, the composite ratio becomes unbalanced and spinnability tends to become poor.

As the other fiber-forming polymer used in the composite fibers, a crystalline thermoplastic polymer having a melting point of 150° C. or higher is preferable from the aspect of heat resistance and dimensional stability. Typical examples thereof are fiber-forming polyesters, polyamides, polyolefins or polyvinyl chloride.

Examples of the polyesters are fiber-forming polyesters formed from aromatic dicarboxylic acids such as terephthalic acid, isophthalic acid, naphthalene-2,6-dicarboxylic acid, phthalic acid, alpha,beta-(4-carboxyphenoxy)ethane, 4,4'-dicarboxydiphenyl and 5-sodiumsulfoisophthalic acid, aliphatic dicarboxylic acids such as adipic acid and sebacic acid, their esters; and diol compounds such as ethylene glycol, diethylene glycol, 1,4-butanediol, 1,6-hexanediol, neopentyl glycol, cyclohexane-1,4-dimethanol, polyethylene glycol and polytetramethylene glycol. Preferable is a polyester in which not less than 80 mol %, especially not less than 90 mol % of the structural units are ethylene terephthalate units and/or butylene terephthalate units.

Examples of the polyamides are nylon 4, nylon 6, nylon 66, nylon 46, nylon 610 and nylon 12. Examples of the polyolefins are polypropylene and an ethylene/propylene copolymer.

In the composite fibers made of the modified Et/VA copolymer phase and the polyester phase, the modified Et/VA copolymer phase portion is shrunk at times in the dyeing treatment at high temperatures and high pressure. On that occasion, when the dying is conducted in a dyeing solution containing one or more of a salt of a strong acid or a strong base and boric acid, shrinking is preventable.

The composite fibers can take a composite form (fiber section) such as a sheath/core form, a sea/island form, a side-by-side form or a combination thereof. The sheath/core form may be a two-layered sheath/core form or a polylayered sheath/core form of three or more layers. In case of the sea/island form, the shape, the number and the dispersed state of the island can optionally be selected, and part of the island may be exposed to the fiber surface. Moreover, in case of the side-by-side form, in the fiber section normal to the lengthwise direction of the fiber, the side-by-side surface may be straight, circular, arched or of any random curve, and plural contact portions may be parallel to each other, radial or of any optional shape.

In the composite fibers of this invention, one or more of the other fiber-forming polymer phases may be combined with the modified Et/VA copolymer phase.

In either case, to impart high moisture absorption and high water absorption to the composite fibers of this invention, it is advisable that the Et/VA copolymer phase modified with the group (I) and/or the group (II) is exposed to part or the whole of the fiber surface. When the whole of the fiber surface is covered with the other polymer phase, moisture absorption and water absorption are hardly imparted thereto; this is thus unwanted.

The section of the fiber or the composite fiber in this invention may take any form and be circular or modified. In case of the modified section, the form can be flat, elliptical, triangular to octangonal, T-shaped or a form of plural leaves such as 3 to 8 leaves.

The fibers and the composite fibers of this invention can contain, as required, additives such as a fluorescent brightener, a stabilizer, a fire retardant and a colorant which are ordinarily used in the fiber-forming polymer.

The fibers and the yarns of this invention may be long fibers such as monofilaments, short fibers such as staple fibers, filament yarns, spun yarns, and combined filament yarns, blended yarns or doubled, twisted yarns of the fibers of this invention and natural fibers, semisynthetic fibers and other synthetic fibers. Moreover, the fiber products of this invention may be woven fabrics, nonwoven fabrics, final clothing and towels made of those fibers or yarns.

EXAMPLES

This invention is illustrated specifically by the following Examples and Comparative Example.

In said Examples and Comparative Example, a rate (mol %) of modification of an alcoholic hydroxyl group in an Et/VA copolymer with the compound (Ia) [i.e., OHC—$CH_2$—C(H)($CH_3$)—COOB] or the compound (IIa) [i.e., OHC—C($CH_3$)$_2$—COOB], a rate (mol %) of modification of an alcoholic hydroxyl group by cross-link acetalization treatment with a dialdehyde, moisture absorption and water absorption were measured by the following methods.

Measurement of a rate of modification of an alcoholic hydroxyl group with a compound (Ia) or (IIa)

A value obtained by subtracting a polymerization rate (mol %) of an ethylene unit from an Et/VA copolymer was made a vinyl alcohol unit. A rate in which the vinyl alcohol unit was modified with the compound (Ia) or (IIa) [i.e., a rate (mol %) of modification relative to 100 mol % of the vinyl alcohol] was calculated from the additional weight of the modified Et/VA copolymer.

Measurement of a rate of modification of an alcoholic hydroxyl group with a dialdehyde A value obtained by subtracting a polymerization rate (mol %) of an ethylene unit from an Et/VA copolymer was made a vinyl alcohol unit, and a rate in which the vinyl alcohol unit was modified with a dialdehyde [i.e., a rate (mol %) of modification relative to 100 mol % of vinyl alcohol] was calculated from the additional weight of the modified Et/VA copolymer.

Measurement of moisture absorption

A modified fabric was dried at 60° C. for about 7 hours by suction under reduced pressure of 0.1 mmHg, and then taken out, followed by measuring its weight ($M_1$) (g). Immediately, the fabric was left to stand for 1 week in an atmosphere of a temperature of 20° C. and humidity of 65% with sodium nitrite placed at the bottom, and the weight ($M_2$) (g) was measured, and moisture absorption was found according to the following formula.

$$\text{Moisture absorption} = \{(M_2 - M_1)/M_1\} \times 100$$

Measurement of water absorption

It was measured according to JIS-L-1096 corresponding to ASTM D 2402.

EXAMPLE 1

Using methanol as a polymerization solvent and azobis-4-methyloxy-2,4-dimethylvaleronitrile as a polymerization initiator, ethylene and vinyl acetate were radical-polymerized at 60° C. under increased pressure to produce an ethylene/vinyl acetate random copolymer (a number average polymerization degree about 350) having an ethylene content of 44 mol %.

Subsequently, the Et/vinyl acetate random copolymer was saponified with a sodium hydroxide-containing methanol solution to form a wet Et/VA copolymer with 99 mol % or more of the vinyl acetate unit in the copolymer saponified. The obtained Et/VA copolymer was washed repeatedly with excess pure water containing a small amount of acetic acid. Washing with excess pure water was further repeated to make the contents of the alkali metal ion and the alkaline earth metal ion of the copolymer about 10 ppm or less respectively. Then, water was separated from the copolymer with a dehydrator, and the copolymer was well dried in vacuo at 100° C. or below to obtain an Et/VA copolymer (an inherent viscosity $[\eta]=1.05$ dl/g measured in a 85% hydrous phenol solvent at 30° C.).

The above obtained Et/VA copolymer was meltspun at a spinneret temperature of 260° C., and wound up at a spinning rate of 1,000 m/min to obtain Et/VA copolymer multifilaments having 50 denier/24 filaments. The above fiberization step was good without any trouble.

A taffeta fabric was produced using the above multifilaments as a weft and a warp.

The above taffeta fabric was desized at 80° C. for 30 minutes with an aqueous solution containing 1 g/liter of sodium hydroxide and 0.5 g/liter of "Actinol R-100" (a trademark for a surface active agent of Matsumoto Yushi K. K.), then put in a treating bath of the following composition containing a compound (Ia) [OHC—$CH_2$—C(H) ($CH_3$)—$COOCH_3$], and acetalized in a bath ratio of 50:1 at a temperature of 90° C. for a period of time shown in Table 1.

| Treating bath composition | |
|---|---|
| OHC—$CH_2$—C(H)($CH_3$)—$COOCH_3$: | 8 g/liter |
| sulfuric acid: | 2N |
| sodium sulfate: | 20 g/liter |

Subsequently, the taffeta fabric was taken out, and put in an aqueous solution containing 5 g/liter of sodium carbonate at 80° C. for 30 minutes. A carboxylate group (—$COOCH_3$) of a compound (Ia) bound to the Et/VA copolymer was hydrolized into a sodium salt (—COONa), and the fabric was then well washed with water and dried. The modified dried taffeta fabric was thus obtained.

The weight of the obtained taffeta fabric was measured. The rate (mol %) of modification of the alcoholic hydroxyl group of the Et/VA copolymer with the compound (Ia) was measured by the above method. Moisture absorption and water absorption thereof were also measured by the above methods.

The results are shown in Table 1.

TABLE 1

| Run No. | Treating time (hr) | Rate of modification with compound (Ia) (mol %) | Moisture absorption (%) | Water absorption (%) | Water resistance |
|---|---|---|---|---|---|
| 1-a | 0 | 0 | 3 | 80 | ○ |
| 1-b | 0.2 | 2 | 7 | 200 | ○ |
| 1-c | 0.4 | 5 | 11 | 300 | ○ |
| 1-d | 2.5 | 14 | 23 | 600 | ○ |
| 1-e | 10.0 | 48 | — | — | X |

○ . . . The fabric does not dissolve even if dipped in hot water of 80° C. for 30 minutes, maintaining its form.
X . . . After dipped in hot water of 80° C. for 30 minutes, the fabric dissolves, not maintaining its form.

From the results in Table 1, it follows that the fabrics (I-b, I-c and I-d) made of the modified Et/VA copolymer fibers acetalized with the compound (Ia) are quite high in moisture absorption and water absorption, and by adjusting the degree of acetalization moisture absorption and water absorption thereof can be adjusted and water resistance can be maintained.

EXAMPLE 2

An Et/VA copolymer having a content of ethylene shown in Table 2 and a saponification degree of a vinyl acetate unit of 99% was melt spun at a spinneret temperature of 260° C. and wound up at a spinning rate of 1,000 m/min to obtain Et/VA copolymer multifilaments having 75 denier/36 filaments.

A taffeta fabric was produced using the multifilaments as a weft and a warp.

The taffeta fabric was acetalized and hydrolyzed as in Example 1 to obtain a modified dried taffeta fabric. In Example 2, a time for dipping in a treating bath containing the compound (Ia) was 2.5 hours.

The weight of the resulting dried taffeta fabric was measured, and a rate (mol %) of modification of the alcoholic hydroxyl group in the Et/VA copolymer with the compound (Ia) and moisture absorption and water absorption thereof were measured by the above methods.

The results are shown in Table 2 together with evaluation of spinnability in spinning.

TABLE 2

| Run No. | Content of ethylene (mol %) | Spinnability of an Et/VA copolymer before modification | Rate of modification with a compound (Ia) (mol %) | Moisture absorption (%) | Water absorption (%) |
|---|---|---|---|---|---|
| 2-a | 25 | Unspinnable | — | — | — |
| 2-b | 35 | good | 16 | 25.3 | 700 |
| 2-c | 60 | good | 7 | 11.1 | 450 |
| 2-d | 80 | good | 1 | 2.6 | 85 |

From the results in Table 2, it is found that when the content of ethylene in the Et/VA copolymer is too low, spinnability decreases, while when it is too high, the rate of modification with the compound (Ia) is low, making it hard to impart high moisture absorption.

EXAMPLE 3

An Et/VA copolymer having a content of ethylene shown in Table 3 and polyethylene terephthalate (PET) (copolymerizing 8 mol % of isophthalic acid; [$\eta$] of 0.73 dl/g) measured at 30° C. in a solvent mixture of phenol and tetrachloroethane (equal amounts)) were co-spun at a volume ratio shown in Table 3 and drawn to produce composite fibers with 50 denier/24 filaments, having a circular section and a side-by-side structure wherein the Et/VA copolymer and polyethylene terephthalate are juxtaposed right and left.

A plain weave fabric was produced using the composite fibers as a weft and a warp.

The fabric was desized as in Example 1, and dipped in a solution containing a compound (Ia) [OHC—$CH_2$—C(H)($CH_3$)—$COOCH_3$] and having the same treating bath composition as in Example 1 in a bath ratio of 50:1 at 90° C. for 2 hours. Then, a carboxylate ester group was hydrolyzed as in Example 1 to obtain a modified dried plain weave fabric.

A weight of the resulting dried plain weave fabric was measured, and a rate (mol %) of modification of the alcoholic hydroxyl group in the Et/VA copolymer with the compound (Ia) and moisture absorption and water absorption of the fabric were measured by the above methods.

The results are shown in Table 3 together with evaluation of spinnability of the composite fibers before modification.

TABLE 3

| Run No. | Content of ethylene (mol %) | Composite ratio (volume) Et/VA:PET | Spinnability | Rate of modification with compound (Ia) (mol %) | Water absorption (%) |
|---|---|---|---|---|---|
| 3-a | 23 | 50:50 | unspinnable | — | — |
| 3-b | 32 | 50:50 | good | 16 | 14.5 |
| 3-c | 44 | 5:95 | unspinnable | — | — |
| 3-d | 44 | 30:70 | good | 10 | 6.0 |
| 3-e | 44 | 50:50 | good | 13 | 11.0 |
| 3-f | 44 | 70:30 | good | 15 | 14.5 |
| 3-g | 44 | 95:5 | unspinnable | — | — |
| 3-h | 60 | 50:50 | good | 8 | 5.0 |
| 3-i | 75 | 50:50 | good | 0.8 | 0.9 |

The results in Table 3 reveal that the fabric made of the composite fibers modified with the compound (Ia) in this invention is excellent in moisture absorption and that in order to increase spinnability, it is necessary to adjust the content of ethylene in the Et/VA copolymer and the ratio of the Et/VA copolymer and the polyester in the composite fibers.

EXAMPLE 4

An Et/VA copolymer having an ethylene content of 44 mol % and the same polyethylene terephthalate as used in Example 3 were co-spun at a volume ratio of 50:50 and drawn to produce composite yarns with 50 denier/24 filaments which were made of composite fibers having a circular section and a side-by-side structure wherein the Et/VA copolymer and polyethylene terephthalate were juxtaposed right and left. A plain weave fabric was produced using the composite yarns as a weft and a warp.

The fabric was desized as in Example 1, and then dipped in a solution containing the compound (IIa) and having the following treating bath composition in a bath ratio of 50:1 at 90° C. for 2 hours to acetalize the Et/VA copolymer portion.

| Treating bath composition | |
|---|---|
| $OHC—C(CH_3)_2—COOH$ [compound (IIa)] | 8 g/liter |
| sulfuric acid | 2N |

The resulting fabric was then treated in an aqueous solution containing 5 g/liter of sodium carbonate at 80° C. for 30 minutes to convert a pendant carboxyl group on the Et/VA copolymer portion into a sodium salt. The thus treated fabric was washed and dried as in Example 1 to obtain a modified dried plain weave fabric. A rate (mol %) of modification of the Et/VA copolymer in the dried plain weave fabric with the compound (IIa) and moisture absorption and water absorption of the plain weave fabric were measured by the above methods. The results are shown in Table 4.

COMPARATIVE EXAMPLE

Example 4 was repeated except that an aldehyde compound of the formula $$OHC—CH_2—COOH$$

wherein carbon in the alpha-position relative to the carboxyl group is not substituted with a methyl group was used as the aldehyde compound instead of the compound (IIa) used in Example 4. A rate (mol %) of modification with the aldehyde compound and moisture absorption and water absorption of the plain weave fabric were measured. The results are shown in Table 4.

TABLE 4

| | Aldehyde compound | Rate of modification (mol %) | Moisture absorption rate (%) | Water absorption rate (%) |
|---|---|---|---|---|
| Example 4 | $OHC—C(CH_3)_2—COOH$ | 10 | 5 | 200 |
| Comparative Example | $OHC—CH_2—COOH$ | 0.1 | 1.0 | 50 |

From the results in Table 4, it becomes apparent that in Example 4 of this invention using the compound (IIa), the fabric good in moisture absorption and water absorption was obtained by well acetalizing the alcoholic hydroxyl group of the Et/VA copolymer, while in Comparative Example using the aldehyde compound with the carbon atom in the alpha-position unsubstituted with the alkyl group, the alcoholic hydroxyl group in the Et/VA copolymer is hardly acetalized, and the fabric is poor in moisture absorption and water absorption.

EXAMPLE 5

A plain weave fabric was prepared as in Example 4 and desized as in Example 1. The resulting fabric was dipped in a solution containing a compound (Ia) and having the following treating bath composition in a bath ratio of 50:1 at 90° C. for 2 hours to acetalize the alcoholic hydroxyl group of the Et/VA copolymer. A rate of acetalization (a rate of modification) was 5 mol %.

| Treating bath composition | |
|---|---|
| $OHC—CH_2—C(H)(CH_3)—COOH$ [compound (Ia)]: | 8 g/liter |
| sulfuric acid: | 2N |
| sodium sulfate: | 20 g/liter |

After washed with water, the fabric was dipped in an oxidizing bath containing 5 g/liter of a 30% hydrogen peroxide solution in a bath ratio of 50:1 at 80° C. for 30 minutes for oxidation, and then further dipped in a crosslinking bath having the following composition in a bath ratio of 50:1 at 90° C. for 2 hours to conduct crosslinking with glutaraldehyde (dialdehyde) of the Et/VA copolymer.

| Crosslinking bath composition | |
|---|---|
| glutaraldehyde (as a pure content): | 5 g/liter |
| sulfuric acid: | 0.4N |
| sodium sulfate: | 20 g/liter |

The fabric was then washed and dried to obtain the modified, crosslinked, dried plain weave fabric.

Said plain weave fabric was dyed under the following conditions to obtain a good dyed fabric without occurrence of agglutination and shrink.

| Dyeing conditions | |
|---|---|
| Dye: Sumikaron Blue SE-RPD: | 2 % owf |
| Dispersant: NIKKA-SUNSOLT #7000 (a trademark for a product of Nikka Kagaku K.K.): | 0.5 g/liter |
| pH adjuster: ammonium sulfate: | 1 g/liter |
| PH adjuster: acetic acid (48%) | 1 cc/liter |
| Bath ratio: | 50:1 |
| Dyeing temperature: | 110° C. |
| Dyeing time: | 40 minutes |

Effects of the Invention

The fibers, the yarns and the fiber products of this invention have durability, high moisture absorption and high water absorption which are not lost even by dyeing treatment or cleaning, and can therefore be used in underwear, intermediate garments, sheets, towels, etc. requiring moisture absorption and water absorption. Besides, they have characteristics that they are swollen upon absorbing a very large amount of water, and owing to the characteristics, they can be used not only in the above usage but also in high molecular absorbents, a water retaining agent, and so forth.

The moisture-absorbable, water-absorbable fibers, yarns and fiber products of this invention are soft and quite bulky, having feeling like natural fibers.

Moreover, according to the process of this invention, the fibers, the yarns and the fiber products having high moisture absorption and high water absorption can easily be obtained by adjusting the ethylene content of the Et/VA copolymer, the rate of modification with the group (I) and/or the group (II) and the composite ratio of the Et/VA copolymer and the other thermoplastic polymer, without decreasing strength of the fibers, causing troubles in the polymer designing or the fiberization step or allowing undesirous coloration.

What we claim is:

1. Composite fibers comprising (a) a phase of a vinyl alcohol unit-containing polymer comprising vinyl alcohol units whose alcoholic hydroxyl group is modified with at least one of the groups represented by the formulas $$>CH-CH_2-C(R^1)(R^2)-COOA \quad (I)$$

and $$>CH-C(R^3)(R^4)-COOA \quad (II)$$

wherein A denotes a hydrogen atom or a salt-forming cation $R^1$, $R^2$, $R^3$ and $R^4$, independently from each other, denote a hydrogen atom or an alkyl group, and at least one of $R^1$ and $R^2$ and at least one of $R^3$ and $R^4$ are alkyl groups, via an oxygen atom of the alcoholic hydroxyl group, and (b) a fiber-forming polymer phase other than component (a).

2. The fibers of claim 1 wherein the vinyl alcohol unit-containing polymer contains 30 to 70 mol % of the vinyl alcohol units, including the modified vinyl alcohol units, based on the total amount of the recurring units.

3. The fibers of claim 1 wherein the vinyl alcohol unit-containing polymer contains 70 to 30 mol %, based on the total amount of the recurring units, of ethylene units.

4. The fibers of claim 1 wherein 1 to 45 mol %, based on the total amount of the vinyl alcohol units, of the vinyl alcohol unit-containing polymer is modified with at least one of the group of formula (I) and the group of formula (II).

5. The fibers of claim 1 wherein A is an alkali metal ion.

6. The composite fibers of claim 1 wherein the volume ratio of (a) the phase of the modified vinyl alcohol unit-containing polymer and (b) the fiber-forming polymer phase is 10:90 to 90:10.

7. The composite fibers of claim 6 wherein the fiber-forming polymer phase is a polyester, a polyamide or a polyolefin.

* * * * *